United States Patent [19]

Karol et al.

[11] 4,296,985

[45] Oct. 27, 1981

[54] INTEGRAL ELECTRICAL CONTACT AND METHOD OF MAKING SAME

[75] Inventors: James J. Karol, Unadilla; Richard W. Normann, Otego; Lloyd C. Hotchkiss, Downsville, all of N.Y.

[73] Assignee: The Bendix Corporation, Southfield, Mich.

[21] Appl. No.: 82,440

[22] Filed: Oct. 9, 1979

[51] Int. Cl.[3] ..... H01R 43/12; H01R 43/14

[52] U.S. Cl. ..... 339/48; 29/826; 29/874; 310/251; 339/256 R

[58] Field of Search ..... 29/826, 874, 877–879, 29/882; 339/47 R–49, 252 P, 256 R, 276 T; 310/248, 249, 251

[56] References Cited

U.S. PATENT DOCUMENTS

| | | | |
|---|---|---|---|
| 2,716,684 | 8/1955 | Barnes | 29/826 X |
| 3,936,624 | 2/1976 | Andersen et al. | 29/882X |
| 4,206,958 | 6/1980 | Ham et al. | 339/49 R |

FOREIGN PATENT DOCUMENTS

| | | | |
|---|---|---|---|
| 2010134 | 6/1979 | United Kingdom | 29/878 |

*Primary Examiner*—Eugene F. Desmond

*Attorney, Agent, or Firm*—David R. Syrowik; Kenneth A. Seaman; Charles D. Lacina

[57] ABSTRACT

An integral electrical contact (10, 110, 210) and a method for making the electrical contact is disclosed. The contact includes an elongated electrical conducting base portion (19, 119, 219) which has an axial passage (29, 129, 229) extending therethrough and also includes several axially aligned electrical wires (20, 120, 220) integrally formed with the base portion. The wires are axially aligned with the passage of the base portion and extend beyond a first end (18, 118, 218) of the base portion. Each of the wires which extends beyond the first end of the base portion includes an end portion (24, 124, 224) that terminates in an acutely angled surface. The electrical contact is made by coining an electrically conductive flat sheet of material (12) to form a plurality of elongated raised design portions (14, 16, 114, 116, 214, 216) which are axially aligned and extend inwardly from one end surface (13) of the sheet. The design portions are separated by slitting the sheet between the design portions or by further coining the sheet to form the wires. A bevel is placed on the ends of the wires at the end surface of the sheet before the wires are slit apart. The sheet is then rolled so that the wires are axially aligned and adjacent to each other.

20 Claims, 12 Drawing Figures

INTEGRAL ELECTRICAL CONTACT AND METHOD OF MAKING SAME

TECHNICAL FIELD

This invention relates to electrical contacts and in particular to integral electrical contacts which are hermaphroditic and a method for making such integral hermaphroditic contacts.

BACKGROUND ART

Prior patents disclose electrical brush contacts intended to have fine wires inserted into a barrel and crimped to comprise the contact. For example, the U.S. Patent of McKeown et al No. 3,725,844 discloses a hermaphroditic electrical contact wherein seven or more brush wires are crimped at one or more points into place within the inner portion of a passage. As suggested therein, the wires could be soldered or brazed into position so long as the wires are in electric circuit relationship with one another. The crimping operation may be performed by a well-known plier type tool that, when squeezed, applies pressure simultaneously to two pairs of diametrically opposed points in the circumference of the contact to conform the contact wall to the wires within the contact.

Each of the contacts and wires associated with such a contact are quite small (the contacts being about one-half of an inch long with a diameter of about 0.060 inches). Generally, electrical contacts are machined from metal stock and, because of their small size, the contacts are machined to tolerances of 0.002 inches or less. A contact which is oversized for any reason cannot be utilized because it may not be possible to insert such a contact into the contact receiving holes in a connector insert or insufficient clearance between contacts could cause electrical and mechanical problems.

Machining of electrical contacts is expensive and because of the large number of contacts utilized by a connector, the connector can be relatively expensive. To reduce the cost of manufacturing a connector and at the same time provide an electrical contact which provides a secure electrical and mechanical connection when the fine wires are crimped within the contact holder, many inventors have turned to making an electrical contact by stamping and rolling (forming) the contact holder from a sheet of metal. For example, the U.S. Patent of Waldron et al No. 4,072,394 discloses a sleeve that is stamped and formed into a tubular shape from a flat sheet of metal.

Other contacts which are stamped and rolled and which are of the type to which this invention relates are disclosed by the U.S. Patents of Narozny et al No. 3,286,223; Henschen et al No. 3,317,887; and Curr No. 3,721,943. In each of the three patents mentioned immediately above, a joint or seam resulted when the contact was formed by rolling flat stock. The seam was then either welded or brazed to prevent the edges of the open seam of the contact from being displaced with respect to each other during a crimping operation. Such crimping operation can cause the end portion of the contact to distort unsymmetrically so it becomes oversized and cannot be properly inserted in its position in an electrical connector.

Therefore, while it is desirable to replace machined contacts with less expensive electrical contacts which are stamped and formed from a sheet of material, the resulting seam prevents the wires from being crimped within the contact unless the seam is brazed or welded. As can be appreciated, brazing or welding seams is very difficult since the longitudinal seam is only a very small part of a contact diameter (about 0.048 inches).

The U.S. Patent of Kleinmann, U.S. Pat. No. 2,093,198 discloses a brush contact for use in tabular machines wherein the wires are firmly held, side by side, in their holders.

DISCLOSURE OF THE INVENTION

An object of the present invention is to provide a one-piece electrical contact that is simple in construction and economical to manufacture.

Another object of this invention is to replace expensive machined electrical contacts with inexpensive electrical contacts which are completely formed from a single sheet of conductive material.

A further object of the invention is to provide an electrical contact formed from a single sheet of conductive material which, when crimped to a wire, will provide a secure mechanical and good electrical connection to the wire.

It is still another object of the invention to provide an electrical contact that can be duplicated relatively easily in large quantities and at low cost.

It is another object of the present invention to provide an integral electrical contact having an elongated electrical conducting base portion with a plurality of axially aligned electrical conducting wires integrally formed with the base portion.

In carrying out the above objects and other objects of this invention, a preferred embodiment of such an integral electrical contact (10, 110, 210) comprises an elongated electrical conducting base portion (19, 119, 219) having first and second ends (18, 22, 118, 122, 218, 222) and a plurality of axially aligned electrical conducting wires (20, 120, 220) integrally formed with the base portion. The wires extend beyond the first end of the base portion. Each of the wires which extends beyond the first end of the base portion includes an end portion (24, 124, 224) that terminates in an acutely angled surface. The end portions are spreadable to receive a second plurality of electrical conducting wires.

In carrying out the above objects and other objects of this invention, a preferred method of making such an electrical contact from an electrically conductive sheet (12) of material includes the steps of forming a plurality of electrically conductive wires (20, 120, 220) from one portion of the sheet so that the wires are axially aligned and extend inwardly from one end surface (13) of the sheet to a second portion of the sheet, and so that the end portions (24, 124, 224) of the wires at the one end surface of the sheet terminate in acutely angled surfaces. The method further comprises the step of folding a part of the sheet having at least one wire over a second part of the sheet having at least one wire so that the wires are axially aligned.

The objects, features and advantages of the present invention are readily apparent from the following detailed description of the best mode taken in connection with the accompanying drawings.

BEST MODE FOR CARRYING OUT THE INVENTION

Figure 1:
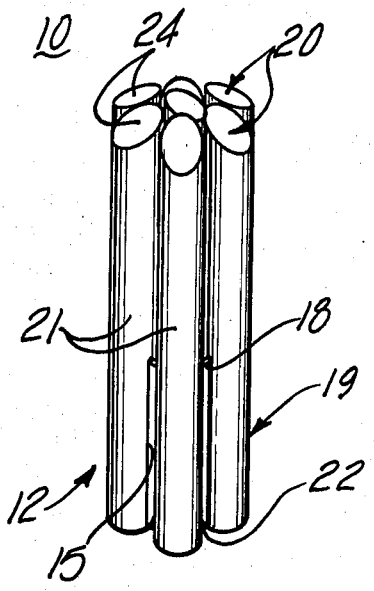
FIG. 1 is a perspective view which shows a first embodiment of an integral electrical contact constructed according to this invention.
Figure 2:
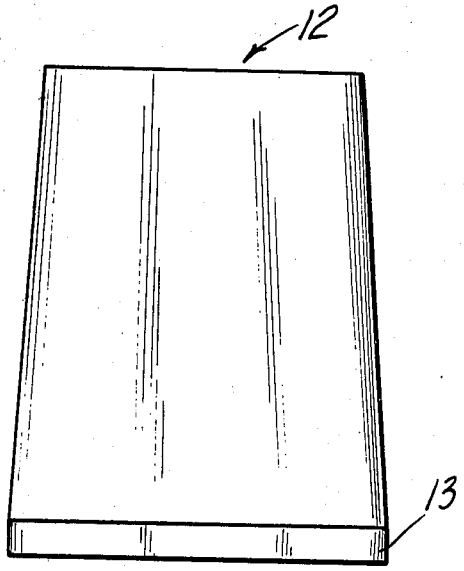
FIG. 2 is a view of a flat sheet of electrically conductive material from which the electrical contact of FIG. 1 is formed.

Referring now to FIG. 1, an integral electrical contact constructed according to the present invention is indicated collectively by reference numeral 10. The one-piece electrical contact 10 is preferably stamped or coined and formed from a flat sheet of electrically conductive material, generally indicated at 12 in FIG. 2, having a wall thickness of about 0.004 inches. The sized sheet 12, while preferably of beryllium copper material, may also comprise other material having similar electrical and mechanical characteristics and not depart from the spirit of the present invention. The sheet 12 may be initially clad or plated such as with gold or tin or other materials to provide the contact 10 with good electrical current carrying characteristics.

Figure 3:
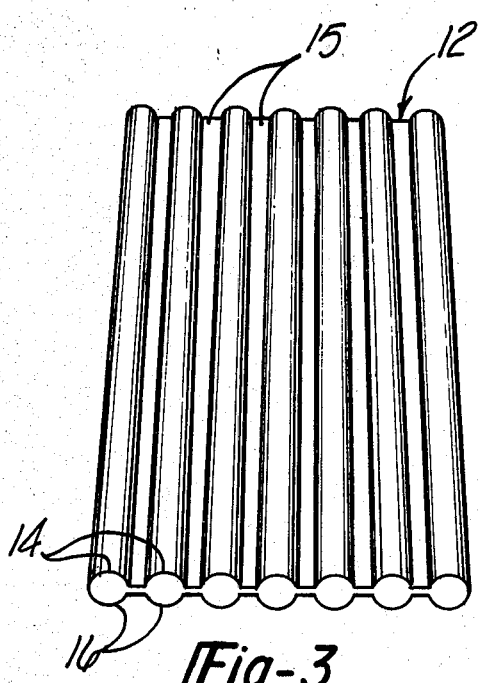
FIG. 3 is a view which shows a partially formed electrical contact of the first embodiment.

Referring now to FIG. 3, the sheet 12 is stamped or coined between a pair of progressive dies (not shown), the dies having working or active surfaces complementary to the desired shape of the coined sheet. The sheet 12, for example, is pressed or squeezed between the two dies at least once and preferably two or three times, the force exerted by the two dies equaling approximately 15 tons for each squeezing step. As a consequence of the cold working, a plurality of curved, raised design portions 14 and 16 are formed at the top surface and the bottom surface, respectively, of the sheet 12 and interconnecting reduced design portions 15 are formed. The design portions 14 and 16 extend parallel to each other along the longitudinal axis of the sheet 12.

The sheet 12 is preferably thickened at the design portions 14 and 16 to a thickness of approximately 0.008 inches and is thinned at the reduced design portions 15 to as small a thickness as practical without substantially distorting the sheet 12.

Figure 4:
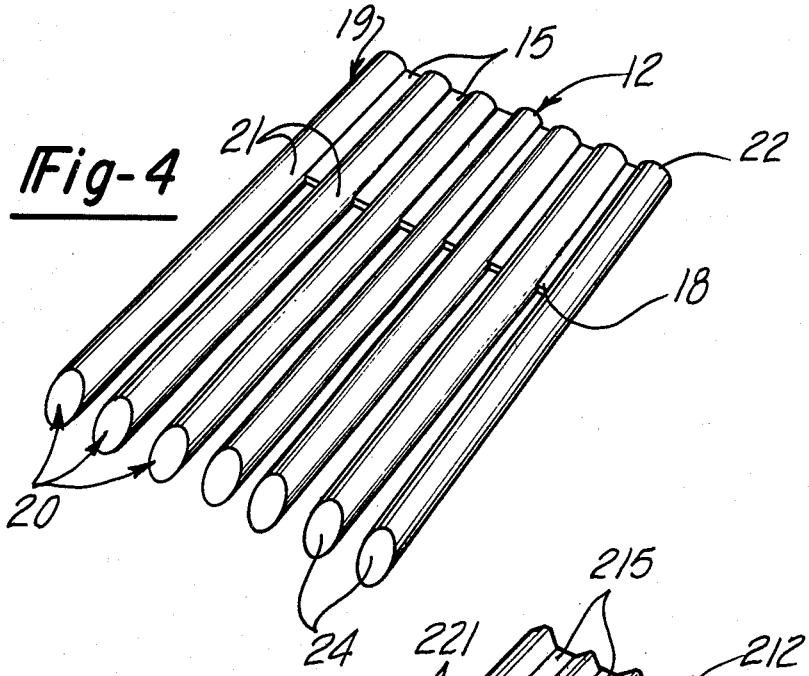
FIG. 4 is a view of the partially formed electrical contact of the first embodiment further illustrating how the electrical contact is formed.

Referring now to FIG. 4, the reduced design portions 15 of the sheet 12 are removed up to a first end 18 of an elongated electrical conducting base portion, generally indicated at 19 of the sheet 12, so as to form seven axially aligned electrical conducting wires generally indicated at 20 which are integral with the base portion 19 at their ends 21. The conductor portion 19 extends between the first end 18 and a second end 22 in an axial direction. The material of the sheet 12 may be removed by either cutting or slitting successive wires 20 apart or by further coining the sheet 12 at the reduced design portions 15.

Referring to FIG. 1, the contact 10 can also be viewed as comprising seven wires 20 which extend the entire length of the contact 10 and which are interconnected by a web comprising the interconnecting reduced design portions 15.

Preferably, before the raised design portions 14 and 16 have been separated to form the wires 20, their ends at the end surface 13 are beveled or, in other words, have angled cuts made at their end portions 24 such as by a cutting die so that the end portions 24 terminate in an acutely angled surface preferably having a 30° included angle. Alternatively, the angled cuts may be made at the end portions 24 during the coining operation by the two coining dies. The angled cuts are made to facilitate sliding movement upon contact with the wires of another conductor (not shown).

Figure 5:
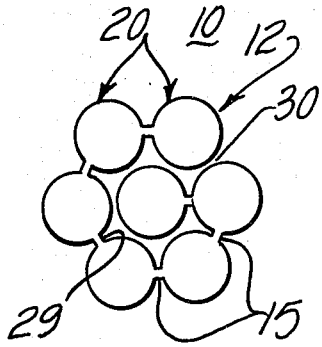
FIG. 5 is an end view of the electrical contact of FIG. 1.

Referring now to FIGS. 1 and 5, the sheet 12 is thereafter folded or rolled in the shape of a spiral as shown in FIG. 5, to form the complete contact 10. The contact 10 includes an axial seam 30 that extends its entire length. The seam 30 is referred to as an open seam because the abutting edges that form the seam 30 are not mechanically bonded together by brazing or welding. Because the wires 20 are integrally formed with the base portion 19, there is no need for the application of a mechanical force such as that applied by a crimping tool to hold the wires 20 to the base portion 19 and therefore the seam 30 need not be mechanically bonded together by brazing or welding.

The wires 21 are spreadable to receive a similar bundle of brush wires of a second contact, thereby establishing an electric circuit connection between the two contacts.

The base portion 19 of the contact 10 could be formed to have a retention shoulder, wire wrap posts, a solder well or cup, crimps, a solderless wrap, printed circuit board pins or tails or the like, which are well known in the art, depending on the desired use of the electrical contact 10.

Figure 8:
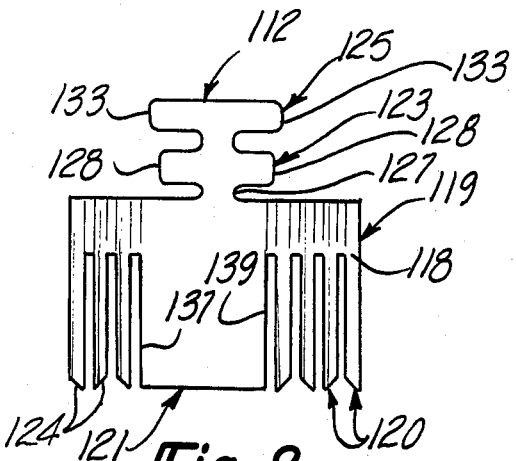
FIG. 8 is a top plan view of a partially formed electrical contact of a third embodiment of the present invention.

With reference to FIG. 8, there is shown another embodiment of the present invention. A sheet of material generally indicated at 112 has been coined and slit at reduced design portions 115 as shown in the first embodiment to form an elongated electrical conducting base portion 119 having first and second ends 118 and 122 and a plurality of wires generally indicated at 120 having beveled end portions 124. The ends of the wires 120 are preferably cut in a plane perpendicular to the plane of the sheet 112. Cutting in this direction would place any burrs formed on the sides of the wires 120 rather than on the ends of the wires 120 which could form undesirable hooks. A medial portion 121 of the sheet 112 is not coined. The sheet 112 also includes integrally formed arm and leg portions generally indicated at 123 and 125 respectively, and an interconnecting neck portion 127, all of which have been cut out of the sheet 112.

Figure 9:
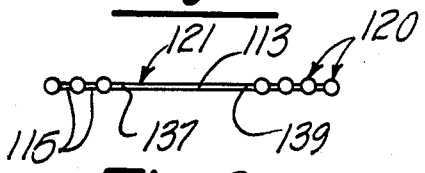
FIG. 9 is an end view of the electrical contact of FIG. 7.

As shown in FIG. 9, opposite ends 128 of the arm portion 123 are folded together to form a longitudinal seam 131, and the ends 133 of the leg portion 125 are folded together to form a longitudinal seam 135. The folded arm portion 123 is thereby adapted to receive the stripped end of an electrical conductor (not shown) therein which may thereafter be crimped to the arm portion 123. The folded leg portion 125 has a greater diameter than the folded arm portion 123 to receive therein and accommodate for the increased diameter of the electrical conductor having electrical insulation formed thereon.

Figure 12:
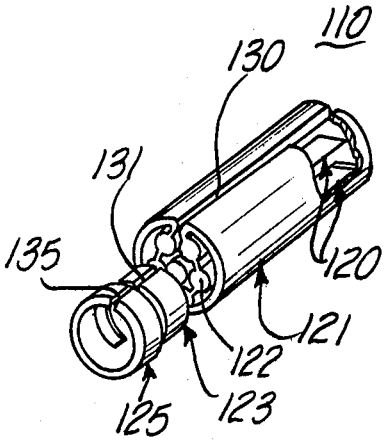
FIG. 12 is a perspective view partially broken away of the third embodiment.
Figure 10:
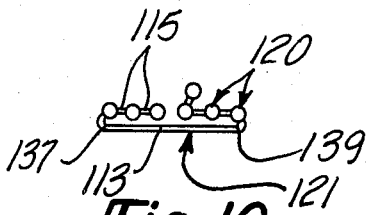
FIG. 10 is an end view of the third embodiment partially folded.
Figure 11:
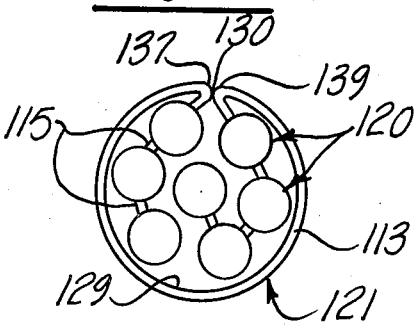
FIG. 11 is a slightly enlarged end view of the third embodiment completely folded.

As shown in FIGS. 10, 11 and 12, the wires 120 are folded or rolled within the medial portion 121 which thereby serves as a holder or outer protective shell for the wires 120 and the base portion 119. The sheet 112 is folded so that the wires 120 are disposed within an axial passage 129 of the folded-up medial portion 121 and are axially aligned therein. The side edges 137 and 139 of the folded medial portion 121 are positioned immediately adjacent each other to thereby form an axial seam 130 that runs or extends the entire longitudinal length of the rolled medial portion 121.

Figure 6:
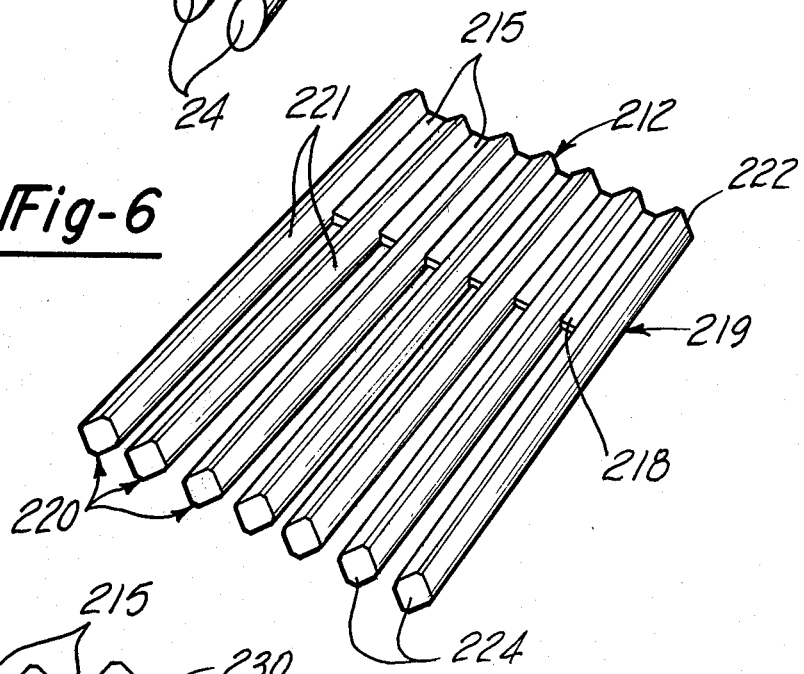
FIG. 6 is a view of a partially formed electrical contact of a second embodiment similar to the partially formed electrical contact of FIG. 4.
Figure 7:
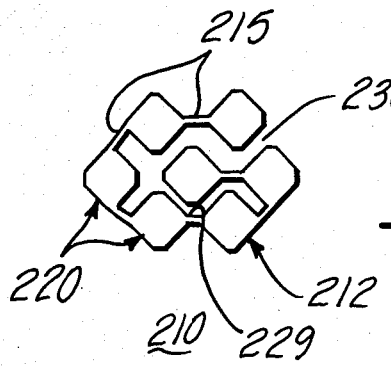
FIG. 7 is an end view of the formed electrical contact of FIG. 6.

Referring to FIGS. 6 and 7, there is shown another embodiment of the present invention including a sheet of material 212 similar to the sheets 12 and 112 and which has been coined and slit to form an elongated electrical conducting base portion 219 having first and second ends 218 and 222 and square wires 220 which have their end portions 224 beveled and their opposite end portions 221 integrally connected to the first end 218 of the base portion 219. As in the other two embodiments, when the coined sheet 212 is folded, an axial seam 230 is formed and extends along the longitudinal length of the formed contact 210. Also as before, the base portion 219 defines an axial passage 229 with which the integrally formed wires 220 are axially aligned.

The sheets 12, 112, and 212 may be initially clad or plated with a gold, tin or other metal layer or a metal solution could be used to plate the formed contacts 10, 110, and 210 to provide the contacts 10, 110 and 210 with good electrical current carrying characteristics.

As can be readily appreciated, all of the wires 120 of the coined sheet 112 may be disposed on either side of the medial portion 121. Furthermore, the wires 120 may extend beyond the end surface 113 of the medial portion 121 or terminate at or before the end surface 113 of the medial portion 121.

While a preferred embodiment and other embodiments of an integral electrical contact and the methods of forming the integral electrical contacts have been shown and described herein in detail, those skilled in the art will recognize various alternative designs, embodiments, and methods for practicing the present invention as defined by the following claims.

What is claimed is:

1. An integral electrical contact comprising:

an elongated electrical and conducting base portion having first and second ends;

a plurality of electrical conducting wires integrally formed with the base portion; and a like plurality of axially aligned raised design portions integrally formed with the base portion, each of said wires being axially aligned with one of said raised design portions, each of said wires extending beyond the first end of said base portion and each including an end portion that terminates in an acutely angled surface, said end portions being spreadable to receive a second plurality of electrical conducting wires.

2. The contact as defined in claim 1 wherein said base portion is generally cylindrical.

3. The contact as defined in claim 1 wherein said base portion has an axial passage extending between the first and second ends and wherein said wires are axially aligned with said passage.

4. The contact as defined in claim 1 including an elongated conductor portion integrally formed with the base portion and having an axial passageway, wherein said wires are axially aligned and axially disposed within the passageway.

5. The contact as defined in claim 1 or claim 4 including a conductive body integrally formed with the base portion at the second end and adapted for connection in electric circuit relationship with a separate conductor.

6. The contact as defined in claim 5 wherein said conductive body has an axial body passage adapted to receive the separate conductor therein.

7. The contact as defined in claim 1 including a second like plurality of axially aligned raised design portions integrally formed with the base portion, each of the design portions of said second plurality and a corresponding design portion of the first plurality defining a design pair, each of said wires being axially aligned with one of said design pairs.

8. A method of making an electrical contact from an electrically conductive sheet of material, the steps of the method comprising:

forming a plurality of elongated raised design portions on the sheet so that the design portions are axially aligned and extend to at least one end surface of the sheet, separating successive raised design portions extending inwardly from the one end surface of the sheet to form electrically conductive wires, removing portions of material at the one end surface of the sheet defining the end portions of the wires so that each end portion terminates in an acutely angled surface, and folding a part of the sheet having at least one wire over a second part of the sheet having at least one wire so that the wires are axially aligned.

9. The method as defined in claim 8 wherein the step of forming includes the step of coining the sheet to form the raised design portions and a second plurality of reduced design portions between the raised design portions.

10. The method as defined in claim 9 wherein the folding step includes the step of rolling the first part of the sheet over the second part of the sheet so that the wires are axially aligned and adjacent to each other.

11. The method as defined in claim 9 wherein the first part of the sheet is flat and wherein the folding step includes the step of rolling the first part of the sheet over the second part of the sheet so that the wires are surrounded by the first part.

12. The method as defined in claim 9 or claim 10 wherein the sheet includes an end portion opposite the one end surface and further includes the step of forming the end portion of the sheet into a tubular form to receive a conductor body therein.

13. The method as defined in claim 9 wherein the step of separating includes the step of slitting the sheet therethrough at the reduced design portion.

14. The method as defined in claim 9 wherein the step of separating includes the step of coining the sheet at the reduced design portions.

15. A method of making an electrical contact from an electrically conductive sheet of material, the steps of the method comprising:

forming a plurality of electrically conductive wires from one portion of the sheet so that the wires are axially aligned and extend inwardly from one end surface of the sheet to a second portion of the sheet and so that the end portions of the wires at the one end surface of the sheet terminate in acutely angled surfaces, and folding a part of the sheet having at least one wire over a second part of the sheet having at least one wire so that the wires are axially aligned.

16. A method of making an electrical contact from an electrically conductive sheet of material, the steps of the method comprising:

forming a plurality of electrically conductive wires from one portion of the sheet so that the wires are axially aligned and extend inwardly from one end surface of the sheet to a second portion of the sheet, removing portions of material at the one end surface of the sheet defining the end portions of the wires so that each end portion terminates in an acutely angled surface, and folding a part of the sheet having at least one wire over a second part of the sheet having at least one wire so that the wires are axially aligned.

17. The method as defined in claim 16 wherein the step of forming includes the step of coining the sheet to form the wires.

18. The method as defined in claim 16 wherein the step of folding includes the step of rolling the first part of the sheet over the second part of the sheet so that the wires are axially aligned and formed in the shape of a spiral.

19. An electrical contact stamped and formed from electrically conductive material, said contact comprising:

a contact portion;

a shell protectively surrounding the contact portion, the shell being formed into a substantially closed cylinder having first and second longitudinal edges meeting at a seam; and means coupling the shell to the contact portion, said contact portion comprising a succeeding plurality of straight wires aligned along parallel axes having forward and rearward end portions and a plurality of coupling webs, the rearward end portions of each successive pair of wires being interconnected by one of said coupling webs and the forward end portions of the wires being spreadable upon mating, the forward end of each wire having an acutely angled end surface, said coupling webs being relatively thin compared with the diameter of the wires so that the wires can be formed into a bundle in the shell.

20. An electrical contact stamped and formed from electrically conductive material, said contact comprising:

a contact portion, a shell protectively surrounding the contact portion, the shell being formed into a substantially closed cylinder having first and second longitudinal edges meeting at a seam; and means for coupling the shell to the contact portion, said contact portion comprising a pair of contact members, each contact member including a succeeding plurality of straight wires aligned along parallel axes having forward and rearward end portions and a plurality of coupling webs, the rearward end portions of each successive pair of wires being interconnected by one of said coupling webs and the forward end portions of each wire having an acutely angled end surface, the forward end portions being spreadable upon mating, said coupling means comprises a pair of additional coupling webs, one of said additional coupling webs connecting one of the contact members to one longitudinal edge of the shell and the other additional coupling web connecting the other contact member to the other longitudinal edge of the shell, said additional webs being connected to the first respective wire of each contact member, said webs being relatively thin compared to the diameter of the wires so that each of the contact members can be folded about one another and into a bundle.

* * * * *